United States Patent [19]

Dexter

[11] 3,945,209

[45] Mar. 23, 1976

[54] HYDRAULIC LINKAGE

[76] Inventor: Robert G. Dexter, 68 Laurel Lane, Lunenburg, Mass. 01462

[22] Filed: Oct. 4, 1974

[21] Appl. No.: 512,141

[52] U.S. Cl. ..... 60/546; 60/562; 60/572; 60/574; 60/592; 137/493.9

[51] Int. Cl.[2] ..... F15B 7/00

[58] Field of Search ..... 60/567, 546, 571, 572, 60/573, 574, 542, 543, 584, 592, 591, 585, 539

[56] References Cited

UNITED STATES PATENTS

| | | | |
|---|---|---|---|
| 2,292,278 | 8/1942 | Lorenz | 60/546 |
| 2,414,302 | 1/1947 | Hebel | 60/567 |
| 2,445,781 | 7/1948 | Hrdlicka | 60/546 |
| 2,540,879 | 2/1951 | Hebel et al. | 60/572 |
| 2,616,265 | 11/1952 | Wilson | 60/546 |

FOREIGN PATENTS OR APPLICATIONS

| | | | |
|---|---|---|---|
| 400,677 | 11/1933 | United Kingdom | 60/572 |

*Primary Examiner*—Martin P. Schwadren
*Assistant Examiner*—Harold Burks

[57] ABSTRACT

A hydraulic linkage for transmitting reciprocating motion comprising a master unit, a slave unit, the master and slave units each comprising a pair of interconnected rod pistons reciprocally moveable within the cylinders in opposite directions by a force applied to the pistons, hydraulic lines connecting one master cylinder to one slave cylinder for transmitting motion from master to slave, a reservoir, a pair of one-way pressure valves mounted in opposite directions and in parallel between the reservoir and each master-slave connection so that volumetric increases in the fluid in the system will be forced out through a first valve of each valve pair and to the reservoir, and volumetric decreases in the fluid in the system will draw fluid from the reservoir through a second valve of each valve pair, thereby providing volume change compensation. A two-way pressure valve comprising a housing having a pair of openings connected by a bore for passage of fluid therethrough, a pair of plungers located within the bore and biased against each other so that the first plunger is seated against the housing and the second plunger is seated against a hole in the end of the first plunger, each plunger having a chamber communicating with one opening and a passageway connecting the chamber in the direction of the other opening, so that a predetermined amount of net fluid pressure within the second plunger chamber will urge the second plunger against the first plunger to unseat the first plunger from the housing and thereby permit the passage of fluid from the second plunger chamber through the passageway into the bore, and then through a gap between the housing and the first plunger created by the unseating and out of the other opening, and so that predetermined pressure within the first plunger chamber will unseat the second plunger from the first plunger, permitting fluid to flow through the hole in the opposite direction.

10 Claims, 6 Drawing Figures

HYDRAULIC LINKAGE

BACKGROUND OF THE INVENTION

This invention relates to master-slave hydraulic linkages.

Hydraulic systems are known for transmitting motion at a distance. Since such systems operate on the principle that the hydraulic fluid is incompressible, many schemes have been proposed to compensate for unwanted changes in fluid volume, caused by such factors as temperature change, introduction of foreign matter, and fluid leakage, in order to keep the master and slave always synchronized. One such scheme, shown in Hebel et al., U.S. Pat. No. 3,363,418, utilizes pairs of oppositely acting check valves connecting a master cylinder to a reservoir kept under pressure, the valves acting either to release excess fluid or to make up for a fluid deficiency from the reservoir. Stark et al., U.S. Pat. No. 3,579,989, shows a similar scheme using a check valve and a pressure relief valve in parallel to vent or fill a master-slave circuit.

The systems described are generally for power steering applications. When it is desired to transfer rapidly reciprocating motion, up to 200 cycles per minute, to several locations, such as in the tooling of an indexing turret machine, it is desirable to move as little fluid as possible by having as small a piston diameter as possible and to have an easily controlled piston diameter in both directions. Conventional pistons with rods are difficult to build below ¾ inch diameter, and because of the rod size requirement, the piston area on the head end is not the same as the area on the rod end. There is also the possibility of leakage past a conventional piston, causing lack of synchronization between master and slave. Also, it is desirable to insure that synchronization of master and slave is maintained on every stroke by having a compensation scheme that would operate effectively under rapid cycling. Compensation circuitry that remains inactive until needed is generally not reliable. Finally, it is desirable to use controllable fluid pressures to have protection against overload at the workpiece.

In transmitting reciprocating motion, pneumatic cylinders and mechanical linkages are also well known. Pneumatic cylinders require fairly complex control systems, including interlocks to prevent sticking valves, and at higher speeds (on the order of 2 linear feet per second), cushioned cylinders become ineffective in preventing impact, and it is necessary to add hydraulic snubbers to absorb impact. Cam driven mechanical linkages require many moving parts where the required motions are located at various points and at various angles in a machine. It would be desirable to transmit the positive motions of cams without needing a variety of different cranks, links, levers, and bearings.

Finally, the use of rod pistons in hydraulic systems is not, stated that broadly, new. However, their use has been in slow, high pressure applications where a heavy rod was desired and the rod was on the order of six inches in diameter.

SUMMARY OF THE INVENTION

The invention provides a simple, compact, rugged, self-synchronizing, accurate, and reliable hydraulic linkage having few components and a two-way combination valve which compactly and reliably acts as a check valve in one direction and a pressure valve in the other direction for use in a fluid compensation arrangement as part of the hydraulic linkage.

The linkage can be used to transmit reciprocating motion to a number of remote places, the motion having a frequency up to about 200 cycles per minute. The linkage automatically compensates during each stroke for undesired changes in fluid volume. The compensation valving operates reliably even at rapid cycling. The use of a pair of opposed rod pistons in independent cylinders in the master and slave units enables the piston diameter to be made small, even down to ¼ inch, and the piston diameters in both directions to be identical. It also provides for positive action in either direction. Only one seal is needed per cylinder, where the rod enters the cylinder. There is no problem of fluid crossover, as there would be with a conventional piston where fluid can leak from one side of the piston to the other. A smaller piston diameter means less fluid is moved per stroke, thereby permitting faster operation with less heat build-up. The stroke length and stroke force of the slave are easily adjusted by varying the master-slave piston diameter ratio and also by varying the size of the stop on the slave. Multiplied force or displacement is thus possible, and the master and slave can be made in standard sizes.

The system is kept air free. A cam designed for use with the master and slave prevents slave moving parts from hard impacting against the stationary parts. A variety of cams can be run from one power source and be connected to several masters to provide several different motions simultaneously. The settings of the valves can be adjusted to provide overload protection to avoid, for example, smashing tools, and retraction safeguards when, for example, a tool is caught in the machine.

The two-way combination valve integrates two valves into one valve having fewer total parts and requiring two lines for a parallel connection instead of four. The pressure settings of the two valve parts of the valve are independent.

In general the invention in one aspect features a hydraulic linkage for transmitting reciprocating motion comprising a master unit, a slave unit, the master and slave units each comprising a pair of interconnected rod pistons reciprocally moveable within the cylinders in opposite directions upon the application of a force to each pair of pistons, hydraulic lines for containing hydraulic fluid connecting one master cylinder to one slave cylinder and the other master cylinder to the other slave cylinder for transmitting the motion from the master unit to the slave unit, a reservoir of hydraulic fluid connected to the hydraulic lines, a first pair of one-way pressure valves mounted in opposite directions and connected in parallel between the reservoir and the hydraulic line connecting one master cylinder to one slave cylinder, and a second pair of one-way pressure valves mounted in opposite directions and connected in parallel between the reservoir and the hydraulic line connecting the other master cylinder to the other slave cylinder, so that volumetric increases in the hydraulic fluid in the lines and cylinders will be forced out through a first valve of each pair of pressure valves and pass to the reservoir, and volumetric decreases in the fluid in the lines and cylinders will draw fluid from the reservoir through a second valve of each pair of pressure valves, thereby providing volume change compensation. In another aspect the invention features a two-way pressure valve comprising a housing having a pair of openings connected by a bore for passage of fluid therethrough, a pair of plungers located within the bore and biased against each other so that a first plunger is seated against a seat in the housing and the second plunger is seated against a hole in the end of the first plunger, each plunger having a fluid chamber therein communicating with one opening and further having a passageway connecting the chamber in the direction of the other opening, so that a predetermined amount of net fluid pressure within the second plunger chamber will urge the second plunger against the first plunger to unseat the first plunger from the housing and thereby permit the passage of fluid from the second plunger chamber through the passageway into the bore, and then through a gap between the housing and the first plunger created by the unseating and out the other opening, and so that a predetermined amount of net fluid pressure within the first plunger chamber will unseat the second plunger from the first plunger permitting fluid to flow through the hole in the opposite direction.

Preferred embodiments feature a pressure relief valve as the first valve of each pair and a check valve as the second valve of each pair; a longer stroke length for the master pistons than for the slave pistons so that each compression stroke of one master piston forces out more fluid from its cylinder than can be received by the slave cylinder connected to it so that an excess of fluid is forced out through the first valve to the reservoir and further so that each withdrawal stroke of one master piston creates a vacuum which cannot be filled completely by the slave cylinder connected to the master cylinder so that the unfilled vacuum draws fluid from the reservoir through the second valve, the valves thereby being operated during each cycle comprising a compressive and withdrawal stroke of both master pistons; a stop connected to the slave pistons to make their stroke length shorter than that of the master pistons; a reservoir pressurized at above atmospheric pressure to bias the second valve and to prevent entry of air into the fluid; master and slave units each comprising a housing containing the pair of cylinders and a shaft connecting the members of each pair; a cam adapted to impart reciprocating to the master pistons, the cam having a pair of dwells, a rise, and a fall, each dwell dividing the rise and fall into a pair of sectors, one sector providing motion corresponding to the stroke length of each slave piston, the other sector providing motion corresponding to the additional stroke length of each master piston relative to the slave piston stroke length; cam rise and fall sectors providing motion corresponding to the slave piston stroke length shaped to provide accelerated and then decelerated motion in advance of each dwell, thereby to lessen the impact of each slave piston against the slave unit at the end of each stroke; rod pistons having a diameter from ¼ inch to ½ inch; the two-way pressure valve acting as a pressure relief valve in one direction and as a check valve in the other direction; a spring for biasing each plunger of the two-way valve, the springs being independently selected to provide a range of pressure settings for each direction of flow; and the second plunger having a male front portion and the other plunger having a female front portion containing the hole and adapted to receive the male portion when the plungers are biased against each other.

Other advantages and features of the invention will be apparent from the description and drawings herein of a preferred embodiment thereof.

DESCRIPTION OF THE PREFERRED EMBODIMENT

Figure 1:
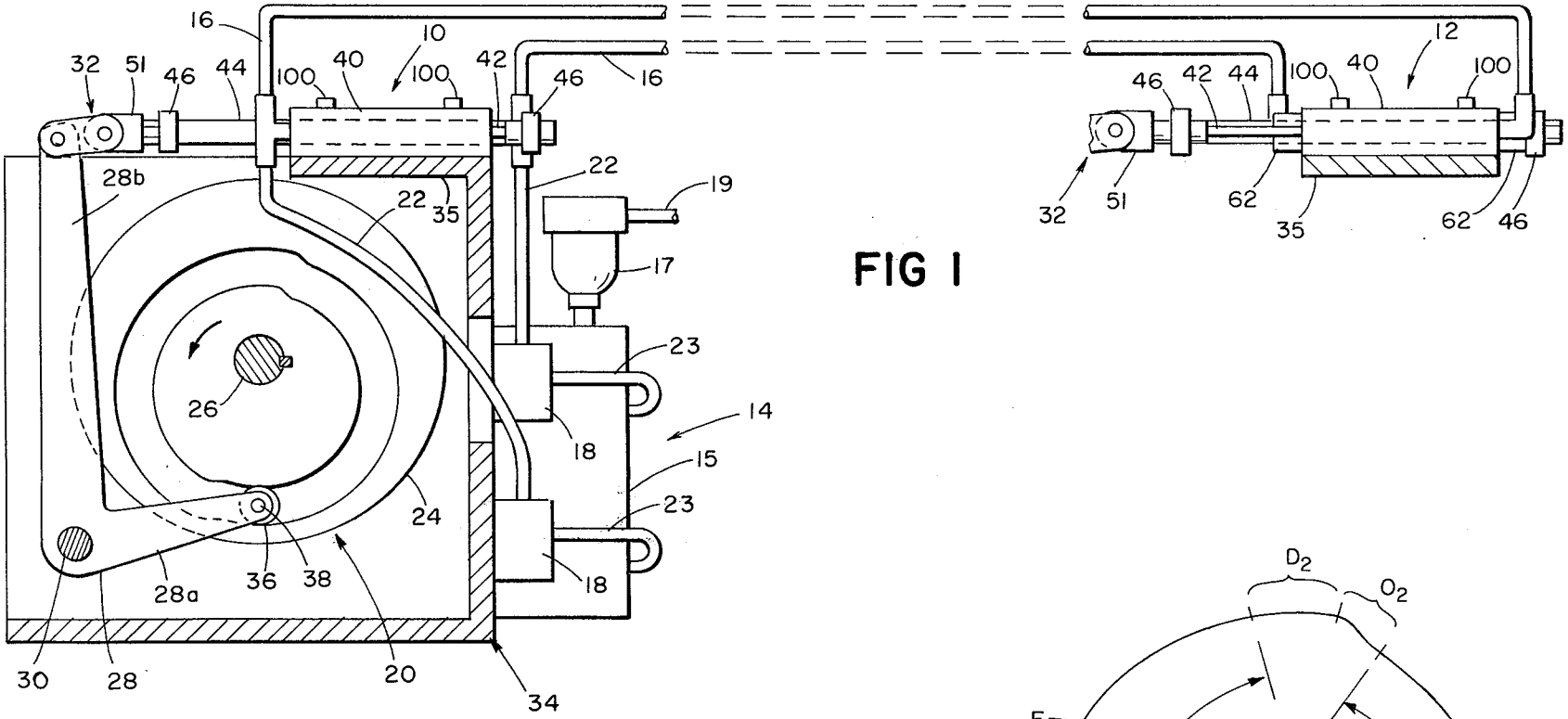
FIG. 1 is a side elevation view, broken away along a vertical plane, of one embodiment of the invention.

There is shown in FIG. 1 a hydraulic linkage comprising master unit 10, slave unit 12, reservoir assembly 14, hydraulic lines 16, two-way pressure valves 18, and cam assembly 20.

Figure 2:
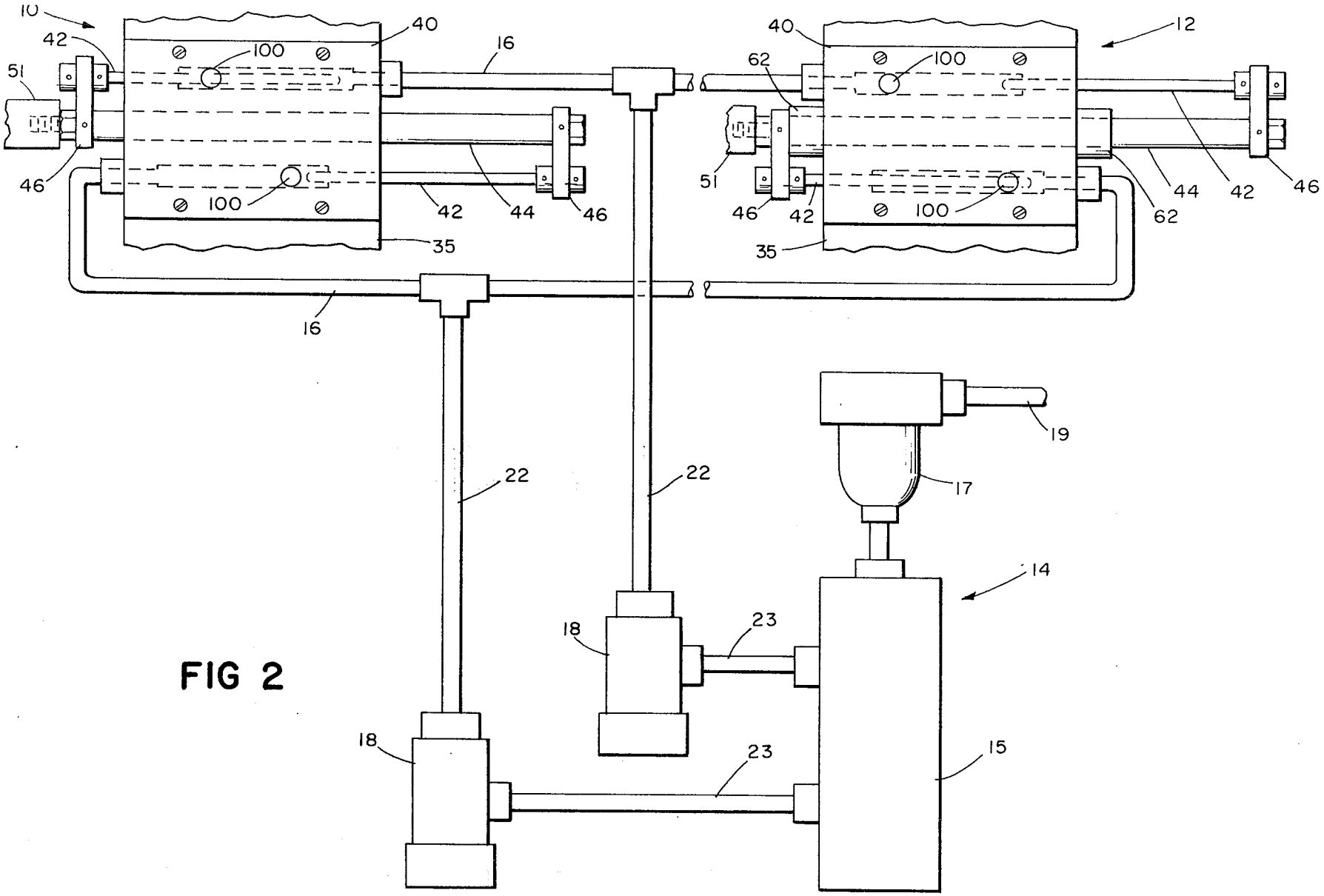
FIG. 2 is a view, partially schematic, of the hydraulic circuitry of FIG. 1.

Master unit 10 is connected to cam assembly 20, which in turn is connected by conventional linkage to a source of power, such as an electric motor (not shown). Master unit 10 is likewise connected (the hydraulic circuitry being shown schematically in FIG. 2) by hydraulic lines 16 to slave unit 12. Each line 16 is connected through hydraulic line 22 to a two-way pressure valve 18, which is in turn connected to reservoir assembly 14, comprising manifold 15 and reservoir 17, by line 23.

Cam assembly 20 comprises path cam 24, rotatable by shaft 26, rocker arm 28, rotatable on shaft 30, linkage 32, and cam box 34. Rocker arm member **28*a* follows the cam track of path cam 24 by means of roller 36 seated within the cam track and fastened to arm member 28*a* by nut 38. Rocker arm member 28*b* is twice the length of member 28*a* so that the displacement imparted to arm member 28*b* is twice that imparted to arm member 28*a*. Linkage 32 comprising two side links pinned at each end connects arm member 28*b* to master unit 10. Hence the greater displacement of arm member 28*b* is imparted to master unit 10. Shafts 26 and 30 are supported in bearings in opposing walls of cam box 34, and master unit 10 is connected to plate 35 of cam box 34. Plate 35 is long enough to mount additional master units, and additional cams can be mounted on shaft 26** so that several different motions can be transmitted from one source of power.

Figure 3:
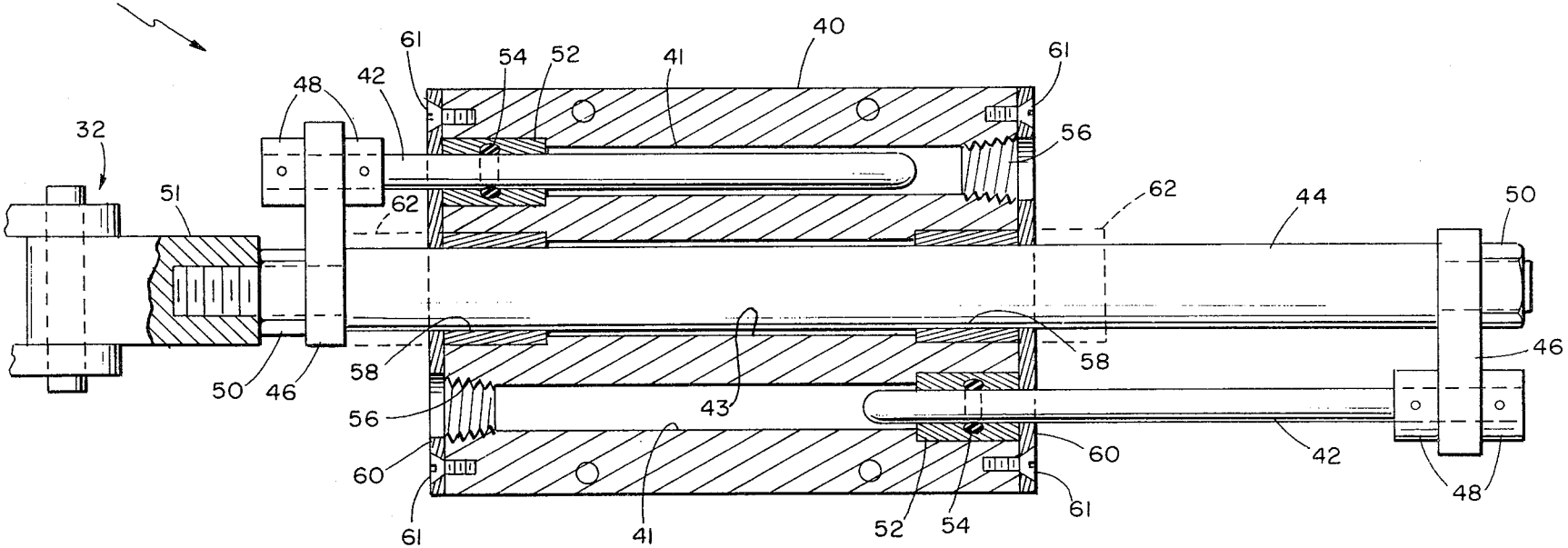
FIG. 3 is a plan view, broken away along a horizontal plane, of the master unit of FIGS. 1 and 2.

Master unit 10, as shown in more detail in FIG. 3, comprises metal cylinder housing 40 having three holes drilled therethrough, cylinders 41 for receiving rod pistons 42 and bore 43 for receiving shaft 44. Rod pistons 42 are each joined to shaft 44 through crossheads 46 secured to the end of each piston 42 by collars 48, pinned to the piston, and to threaded end portions of shaft 44 by nuts 50.

Block 51, threadably connected to the end portion of shaft 44, is pinned between the side links of linkage 32, which in turn is connected to the rest of cam assembly 20 (not shown in FIG. 3). Movement of shaft 44 relative to housing 40 moves one piston 42 into its cylinder 41 and the other piston 42 out of its cylinder 41.

At one end of each cylinder 41 is a counterbored section for press-fittedly seating bushing 52. Seal 54 rests in an inner circumferential groove in bushing 52. Piston 42, riding within bushing 52 and seal 54, does not touch the wall of cylinder 41. At the opposite end of cylinder 41 is threaded outlet 56 for receiving a threaded hydraulic line fitting (not shown in FIG. 3). Shaft 44 is supported by bushings 58, which are press-fitted in counterbored ends of bore 43. Retainer plates 60, secured to each end of housing 40 by screws 61, insure retention of bushings 52 and 58.

Rod pistons 42 have a diameter of ¼ inch. The stroke length of the master pistons is 2 ⅝ inches. Slave unit 12 is identical to master unit 10, with the exceptions that there is no or cam linkage connected to shaft 44 and a stop 62 is provided (shown in phantom in FIG. 3) to limit the stroke length of the slave pistons to ⅛ inch less than the master stroke length, or 2 ½ inches. Using 3 inch stroke cylinders, with cam 24 moving the master pistons 2 ⅝ inches, stop 62, which is a bushing secured to housing 40 and receiving shaft 44, should be ½ inch long to give the master piston the "overtravel" of ⅛ inch.

Figure 4:
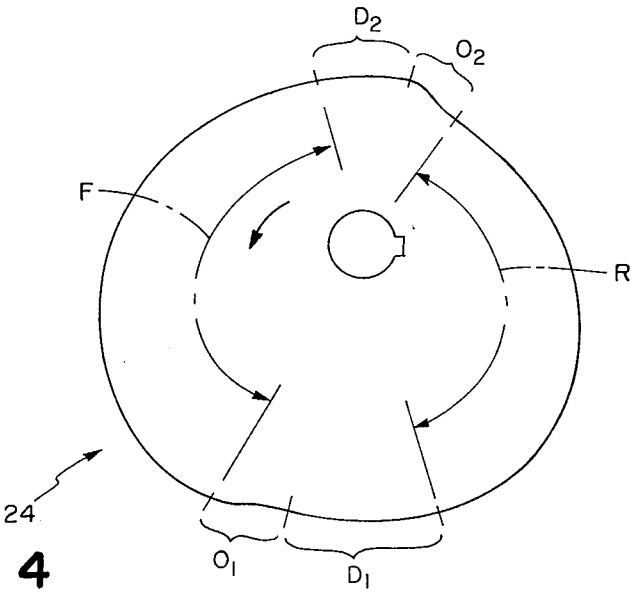
FIG. 4 is a side elevation view of the cam track of the cam of FIG. 1.

Cam 24 is designed to produce the overtravel of the master pistons with respect to the slave pistons. The shape of its track, shown in FIG. 4, includes a rise sector divided into rises R and $O_1$ by dwell $D_1$ and a fall sector divided into falls F and $O_2$ by dwell $D_2$. Rise R gives a displacement of 1 ¼ inches, which becomes a 2 ½ inches displacement on master pistons 42 by the 2:1 rocker arm 28 ratio. Rise $O_1$, the overtravel, is 1/16 inch, or ⅛ inch on the master with the rocker arm ratio. Fall F is likewise 1 ¼ inches, or 2 ½ inches on the master, and fall $O_2$, the return overtravel, is 1/16 inch, or ⅛ inch on the master.

Rise R and fall F are shaped to give smoothly accelerating, then decelerating harmonic motion. Thus when the master piston travels 2 ½ inches, the slave piston likewise travels 2 ½ inches, and slave crosshead 46 hits stop 62. By decelerating through the cam and arriving at the dwell, the impact of the slave crosshead against stop 62 is substantially eliminated. The cam then goes through the dwell in which no motion is transmitted to master 10. Then the cam goes through one of its overtravels ($O_1$ or $O_2$), moving the master piston ⅛ inch, but since slave crosshead 46 is already resting against stop 62, it cannot move, and no banging of the crosshead against the stop occurs.

Figure 5:
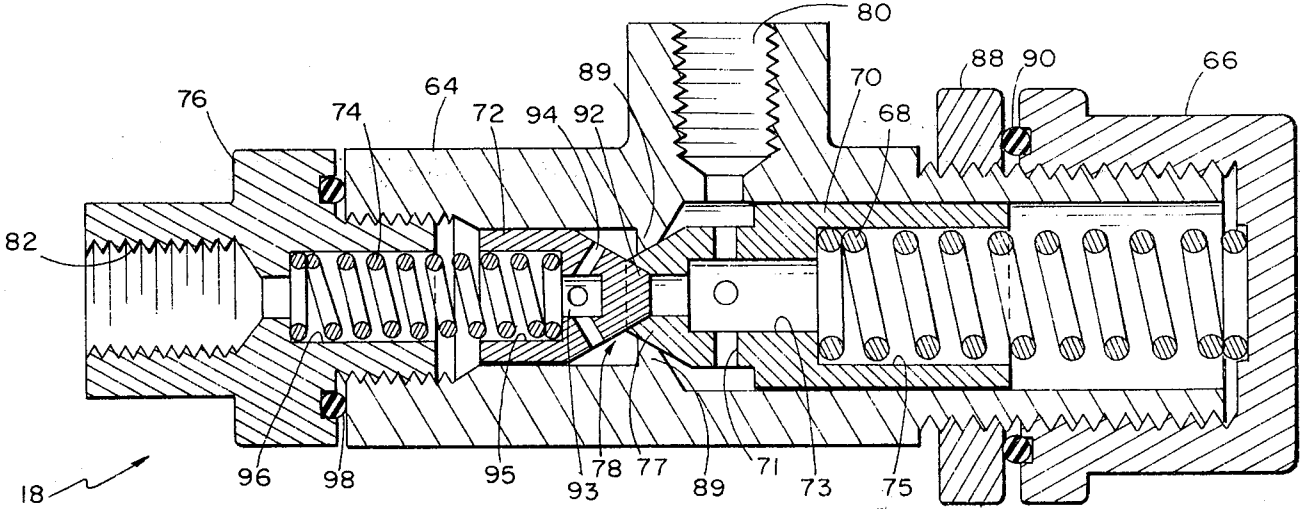
FIG. 5 is a side elevation view, broken away along a vertical plane, of another embodiment of the invention.

Two-way pressure valve 18, shown in detail in FIG. 5, operates to relieve excess fluid pressure caused by increases in fluid volume, and to admit fluid from reservoir 17 when demanded because of a decrease in fluid volume in the system. Valve 18 comprises housing 64, pressure relief cap 66, spring 68, pressure relief plunger 70, check plunger 72, spring 74, and check cap 76. Housing 64 has a bore 78 extending throughout its length. Transversely connecting into said bore is threaded opening 80, which is connected by a hydraulic line 23 to reservoir assembly 14 (not shown). Threaded opening 82 of check cap 76 is connected by hydraulic line 22 to a master and slave cylinder outlet 56 (not shown). Check cap 76 is threadably received at its other end by the threaded female end portion of housing 64. On the other end of the housing 64, pressure relief cap 66 is threadably received by the male threaded end of housing 64. Seated within bore 78 is pressure relief plunger 70. Pressure relief plunger 70 is bored throughout lengthwise, and has four passageways 71 transverse to the central counterbored fluid chamber 73. Counterbored spring chamber 75 holds spring 68, the other end of which seats against the counterbored inner side of check cap 66. Cap 66 can be turned to adjust the spring force, and hence the pressure setting. Lock-and-seal nut 88 is then tightened against cap 66, with O-ring seal 90 held therebetween in an annular groove in cap 66.

Pressure relief plunger 70 is countersunk at its nose 77, into which female portion fits nose 92, the male portion of check plunger 72. Plunger 72 is bored through part of its length to fluid chamber 93 to which are connected four passageways 94, which lead to bore 78. Counterbored spring chamber 95 and check cap counterbored chamber 96 cooperate to retain check spring 74. O-ring 98, fitted in an annular groove in check cap 76, provides the seal between check cap 76 and housing 64.

In operation, the hydraulic lines are filled with fluid. Bleeders 100 enable air to be purged completely from the system in the conventional manner, as it is essential that the lines and cylinders be air-free. The system is then pressurized with air from line 19 to insure operation of the check valves as described below. The source of power is then turned on, rotating cam 24, and imparting reciprocating motion to master shaft 44 through linkage 32 and block 51. During cam rise R, shaft 44 moves, thereby pushing one master piston into its cylinder, forcing fluid out of the cylinder, while at the same time withdrawing the other master piston from its cylinder. Fluid forced out of the first cylinder transmits the force through line 16, and fluid enters the slave cylinder connected to that line, the fluid pushing out on the slave piston. Outward movement of this slave piston, through crossheads 46 and shaft 44, causes an inward movement of the other slave piston, forcing fluid out of its cylinder, through its line 16, and into the master cylinder where the master piston was withdrawing. On each stroke, one of the two master pistons is always moving inward so that, regardless of the direction of movement of master shaft 44, the master unit always transmits motion by positive action, that is, by pushing against the fluid.

At the end of cam rise R or cam fall F, one master piston and one slave piston have moved inward 2 ½ inches. The cam then goes through a dwell before it pushes the master piston inward another ⅛ inch. During the dwell, one slave crosshead 46 is resting against slave stop 62 so that the slave pistons can travel no further. The cam then goes through an overtravel ($O_1$ or $O_2$), which pushes one master piston inward ⅛ inch and withdraws the other master ⅛ inch. Since the slave pistons cannot move, the effect of the extra ⅛ inch inward for one master piston is to force a small amount of fluid through the pressure relief part of one valve 18 and the effect of the extra ⅛ inch outward for the other master piston is to create a vacuum in the master cylinder which sucks fluid from reservoir 17 through the check valve part of the other valve 18. Thus on each stroke, one valve 18 acts as a pressure relief valve, and the other valve 18 acts as a check valve. Additional apparent increases in fluid volume due to temperature rise and decreases in fluid volume due to temperature drop are automatically compensated for on each stroke, since the overtravel of the master pistons keeps valves 18 operating on every stroke and any changes in fluid volume will be reflected in the amount of fluid expelled or sucked in by the overtravel. When reciprocating motion is being transmitted, up to about 200 cycles per minute, the vacuum created at overtravel would be insufficient to operate the check valve part of valve 18 which is set at 6 psig differential. Hence, to remedy this, reservoir 17 is pressurized with 40 psig air, shown entering through air line 19 (the compressor not shown). With the check valves so biased, they will continue to operate effectively. The pressure relief valve part of valve 18 is set much higher, anywhere from 200 psi to 3000 psi. In the embodiment shown, one pressure relief valve in one valve 18 is set from 200 psi to 400 psi and the other in the other valve 18 is set from 1000 psi to 2000 psi. The valve set at the lower range setting is connected to the master piston which, on its compression stroke, moves the slave unit and a tool attached to it. Thus if a foreign object interferes with the tool, the extra pressure built up will actuate the pressure relief valve, set at the lower setting, rather than cause the slave to damage the tool. On the other hand, the pressure relief valve set at the higher range setting is connected to the master piston which, on its compression stroke, pulls the tool away from a machine. Thus if the tool should become stuck for any reason, the master piston can cause the slave to pull back the tool with a high degree of force before the pressure relief valve actuates from the increased pressure. Other settings of the pressure relief valves can be made depending on the desired application for the slave.

The operation of valve 18 in performing the functions of both pressure relief valve and check valve will now be considered. If the master piston overtravels inwardly or if any increase in fluid volume in that line occurs, fluid will flow into opening 82 of check cap 76, through spring chambers 96 and 95 (spring 74 being a hollow compression spring), then into fluid chamber 93, and out passageways 94 into bore 78. Because spring 68 biases pressure relief plunger 70 against seat portion 89 of housing 64, the fluid can go no farther. However, when fluid pressure in chamber 93 and bore 78 is sufficiently high to overcome the force of spring 68, the fluid pushes plunger 72 against plunger 70 and thus compresses spring 68, unseating plunger 70, and permitting fluid to travel between seat 89 and plunger 70 and out opening 80 to manifold 15 and then to reservoir 17.

When, however, a vacuum occurs in the cylinder or line connected to opening 82, the oil from the manifold and reservoir, under air pressure from line 19, enters opening 80, passes through passageways 71 in plunger 70 to fluid chamber 73, and then into the hollow nose 77 of plunger 70, where the fluid bears against solid nose 92 of plunger 72, which in turn bears against spring 74. At a sufficient pressure, plunger 72 is pushed back, compressing spring 74, allowing fluid to pass from the nose of plunger 70 into bore 78, and then into passageways 94, to chamber 93, to spring chambers 95 and 96, and out opening 82, into the system to fill the vacuum. As noted, by operating the check valve or the pressure relief valve part of valve 18 on each stroke, synchronization of master and slave pistons is constantly effected in advance of the next stroke.

It is not necessary that either the master unit or the slave unit be contained in a single housing. Each member of the pair of master or slave cylinders could be put in a separate housing so long as the two pistons were connected to move in opposition, that is, one master or slave piston moving into its cylinder as the other master or slave piston is withdrawing from its cylinder. Also, the piston diameters can be varied. Preferably they should be from ¼ inch to ½ inch. Also, the ratio of master piston diameter to slave piston diameter can be adjusted to multiply or reduce the displacement of the slave relative to the master and the force of the slave relative to the master. Thus if the master diameter is ½ inch and the slave ¼ inch, the displacement of the slave will vary as the square of the diameters, or, here, will be 4 times that of the master with ¼ the force.

The stroke length of the slave piston can be easily modified by changing the stop without the need to go to a different length cylinder. Likewise, one stop per unit can be used effectively, or one for each crosshead.

The hydraulic apparatus described has a capability for reciprocating action of over 200 cycles per minute. Different size cylinders can be used, giving up to 12 inch strokes. The linear velocity of the master and slave can be up to 24 inches per second, or more.

Figure 6:
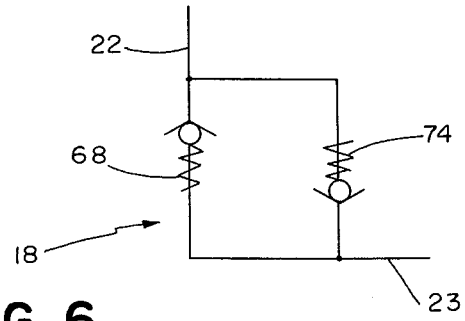
FIG. 6 is a schematic view of a modification in the valves of FIG. 1.

Though not preferred, separate pressure relief and check valves can be used in place of the two-way valve shown, as shown schematically in FIG. 6.

Other embodiments within the invention will be apparent to those skilled in the art.

What is claimed is:

1. A hydraulic linkage for transmitting reciprocating motion comprising:

a master unit, a slave unit, said master and slave units each comprising a pair of cylinders and a pair of interconnected rod pistons reciprocally moveable within said cylinders in opposite directions upon the application of a force to each said pair of pistons, hydraulic lines for containing hydraulic fluid connecting one said master cylinder to one said slave cylinder and said other master cylinder to said other slave cylinder for transmitting said motion from said master unit to said slave unit, a reservoir of hydraulic fluid connected to said hydraulic lines, a first pair of one-way pressure valves mounted in opposite directions and connected in parallel between said reservoir and said hydraulic line connecting one master cylinder to one slave cylinder, and a second pair of one-way pressure valves mounted in opposite directions and connected in parallel between said reservoir and said hydraulic line connecting said other master cylinder to said other slave cylinder, so that volumetric increases in said hydraulic fluid in said lines and cylinders will be forced out through a first valve of each pair of pressure valves and pass to said reservoir, and volumetric decreases in said fluid in said lines and cylinders will draw fluid from said reservoir through a second valve of each pair of pressure valves, thereby providing volume change compensation.

2. The linkage of claim 1 wherein said first valve of each said pair is a pressure relief valve and said second valve of each said pair is a check valve.

3. The linkage of claim 1 wherein said master pistons have a longer stroke length than said slave pistons so that each compression stroke of one master piston forces out more fluid from said one master cylinder than can be received by the slave cylinder connected to said one master cylinder so that an excess of fluid is forced out through said first valve to said reservoir and further so that each withdrawal stroke of one master piston creates a vacuum which cannot be filled completely by the slave cylinder connected to said one master cylinder so that said unfilled vacuum draws fluid from said reservoir through said second valve, said valves thereby being operated during each cycle comprising a compressive and withdrawal stroke of both said master pistons.

4. The linkage of claim 3 wherein said slave unit further comprises a stop connected to said slave pistons to make the stroke length of said slave pistons shorter than the stroke length of said master pistons.

5. The linkage of claim 1 wherein said reservoir is pressurized at above atmospheric pressure to bias said second valve and to prevent entry of air into said fluid.

6. The linkage of claim 1 wherein said master and slave units each further comprise a housing containing said pair of cylinders and a shaft connecting said pair of pistons.

7. The linkage of claim 3 further comprising a cam adapted to impart said motion to said master pistons, said cam having a pair of dwells, a rise, and a fall, each said dwell dividing said rise and said fall into a pair of sectors, one said sector providing motion corresponding to the stroke length of each said slave piston, said other sector providing motion corresponding to the additional stroke length of each said master piston relative to said slave piston stroke length.

8. The linkage of claim 7 wherein said cam rise and fall sectors providing motion corresponding to said slave piston stroke length are shaped to provide accelerated and then decelerated motion in advance of each said dwell, thereby to lessen the impact of each said slave piston against said slave unit at the end of each said stroke.

9. The linkage of claim 1 wherein said rod pistons have a diameter from ¼ inch to ½ inch.

10. The linkage of claim 2 wherein said pressure relief valve and said check valve are made integral into one two-way valve, said check valve part of said two-way valve opening at a lower pressure than said pressure relief valve part.

* * * * *